US009335139B2

(12) United States Patent
Böck

(10) Patent No.: US 9,335,139 B2
(45) Date of Patent: May 10, 2016

(54) SIMULATION CHAMBER AND METHOD FOR SETTING OFF EXPLOSIVE CHARGES CONTAINED IN FREIGHT IN A CONTROLLED MANNER

(71) Applicant: NAUTILUS SOFTWAREDESIGN, Schwabmuenchen (DE)

(72) Inventor: Michael Böck, Schwabmuenchen (DE)

(73) Assignee: NAUTILUS SOFTWAREDESIGN, Klosterlechfeld (DE)

( * ) Notice: Subject to any disclaimer, the term of this patent is extended or adjusted under 35 U.S.C. 154(b) by 15 days.

(21) Appl. No.: 14/345,697

(22) PCT Filed: Sep. 19, 2012

(86) PCT No.: PCT/EP2012/068397

§ 371 (c)(1),
(2) Date: Mar. 19, 2014

(87) PCT Pub. No.: WO2013/041549

PCT Pub. Date: Mar. 28, 2013

(65) Prior Publication Data

US 2014/0245879 A1 Sep. 4, 2014

(30) Foreign Application Priority Data

Sep. 21, 2011 (DE) ..... 10 2011 113 826

(51) Int. Cl.
*F42D 5/04* (2006.01)
*F42D 5/02* (2006.01)
*F42B 33/06* (2006.01)

(52) U.S. Cl.
CPC . *F42D 5/02* (2013.01); *F42B 33/06* (2013.01); *F42D 5/04* (2013.01)

(58) Field of Classification Search
CPC ..... F42B 33/06; F42D 5/04
USPC ..... 86/50; 102/202.1, 202.2
See application file for complete search history.

(56) References Cited

U.S. PATENT DOCUMENTS 5,198,612 A * 3/1993 Myers ..... 102/293
5,274,356 A * 12/1993 Taricco ..... 340/515

(Continued)

FOREIGN PATENT DOCUMENTS

| | | |
|---|---|---|
| DE | 4115713 | 2/1992 |
| EP | 0395261 | 10/1990 |
| GB | 2230698 | 10/1990 |

OTHER PUBLICATIONS

English translation of International Preliminary Report on Patentability dated Mar. 25, 2014 PCT/EP2012/68397 filed Sep. 19, 2012.

(Continued)

*Primary Examiner* — Stephen M Johnson
(74) *Attorney, Agent, or Firm* — Paul D. Bianco; Fleit Gibbons Gutman Bongini & Bianco PL

(57) ABSTRACT

The invention relates to a simulation chamber for setting of explosive charges contained in freight in a controlled manner under simulated conditions, comprising a closed explosion chamber (1), into which the freight (2) is introduced and in which real-time conditions are specified that match ambient conditions of the freight (2) on an intended transport path. In order to further develop such a simulation chamber in such a way that even explosive charges that cannot be detected by means of the hitherto existing examination and testing methods can be recognized, a mobile radio testing unit (4) is provided according to the invention, by means of which a mobile radio device contained in the freight (2) can be detected.

17 Claims, 1 Drawing Sheet

(56) References Cited

U.S. PATENT DOCUMENTS

| | | | | |
|---|---|---|---|---|
| 7,130,624 | B1 | 10/2006 | Jackson et al. | |
| 7,337,686 | B2 | 3/2008 | Sagi-Dolev | |
| 2007/0214950 | A1 | 9/2007 | Mardirossian | |
| 2007/0232304 | A1 | 10/2007 | Goldman et al. | |
| 2008/0083320 | A1 * | 4/2008 | Chang et al. | 89/1.13 |

OTHER PUBLICATIONS

English translation of Written Opinion PCT/EP2012/68397 filed Sep. 19, 2012.
International Search Report dated Dec. 10, 2012 for PCT/EP2012/68397.
Written Opinion for PCT/EP2012/68397.

* cited by examiner

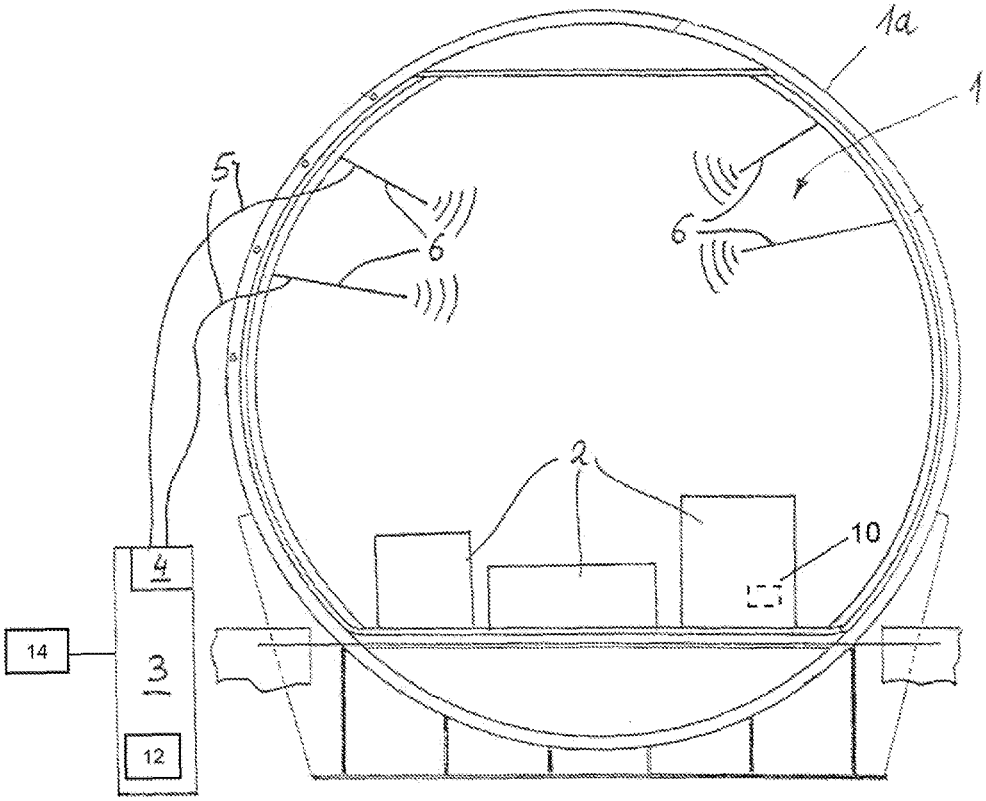
1a
1
5
6
6
2
10
4
14
3
12

SIMULATION CHAMBER AND METHOD FOR SETTING OFF EXPLOSIVE CHARGES CONTAINED IN FREIGHT IN A CONTROLLED MANNER

FIELD OF THE DISCLOSURE

The invention concerns a simulation chamber for setting off explosive charges in freight, in a controlled manner and under simulated conditions. The invention also concerns a method for the controlled setting off of explosive charges contained in freight in such a simulation chamber.

BACKGROUND OF THE DISCLOSURE

In accordance with legal regulations, all freight and mailing shipments that are to be transported by an aircraft are to be subjected, before loading, to a freight scanning, in order to rule out manipulations and, in particular, to prevent freight that contains an explosive charge from being introduced into an aircraft. The inspection of large freight and package quantities by ground personnel, however, is expensive and time-consuming and, moreover, dangerous. Therefore, so-called simulation chambers or explosion or detonation chambers are used, in which large freight, airmail, and package quantities can be examined for explosive charges, whose igniters respond to barometric, acoustic, or electromagnetic signals. Such a simulation chamber is, for example, known from DE 4115713 C1. The freight to be inspected is introduced for this purpose into a closed explosion chamber. Real-time conditions are specified in the explosion chamber, which coincide with the actual ambient conditions or the ambient conditions to be expected on the intended flight path. If a detonable explosive charge whose igniter responds to the conditions simulated in the explosion chamber is found in the explosion chamber, it is, as a rule, thereby destroyed. However, in this way, it can be prevented that the freight containing the explosive charge is introduced into the aircraft and is detonated during the flight or upon landing.

The known simulation chambers can detect explosive charges contained in freight whose igniters respond to barometric signals (excess or reduced pressure), acoustic signals (such as sound waves in the frequency range of 1-20 kHz, which are above a detectable acoustic pressure), or electromagnetic signals (such as radio signals in the frequency range between 120 kHz and 1 GHz).

Recently, freight packages have appeared that are provided with explosive charges that cannot be detected by the known simulation chambers nor by other known air freight testing methods (such as by X-ray investigation or by the detection of traces of explosive materials).

SUMMARY OF THE DISCLOSURE

On this basis, the goal of the invention is to further develop a generic simulation chamber and the generic method for the setting off of explosive charges contained in freight, in a controlled manner and in such a way that explosive charges that cannot be detected with the investigation and testing methods known up to now can also be recognized.

This goal is attained with a simulation chamber and with a method as disclosed herein. Preferred embodiments for the simulation chamber and the method are also disclosed.

At the end of October 2010, a freight package with explosive charges was sent from Yemen to Chicago. The freight package was thereby disguised as a printer with a manipulated print cartridge and was able to pass, without any problem, all safety checks which had also been carried out at the intermediate sites at airports in Cologne/Bonn and London. Due to fortunate circumstances, it was possible to remove the freight package from the aircraft at the intermediate site London as a result of intelligence information before it could be brought to the intended detonation of the explosive charge at the target airport in Chicago. After a careful investigation of the freight package removed from the aircraft, it was determined that explosive material, which was to be brought to detonation via a mobile radio igniter, had been poured into the manipulated print cartridge. The mobile radio igniter could also not be detected by common testing methods, such as X-ray examinations, since a traditional mobile radio telephone (which could possibly have been detected by the X-ray examination) was not contained in the freight package, merely because only the electronic circuit board of traditional radio terminal equipment was incorporated into the electronic unit of the printer, so that this circuit board could not be recognized as mobile radio terminal equipment and thus not as a mobile radio igniter for the incorporated explosive charge. The freight package would also have passed, without any problem, an inspection in a generic simulation chamber, since traditional simulation chambers cannot detect explosive charges with mobile radio-activated igniters and bring them to detonation.

For the detection of such explosive charges that can be activated by mobile radio terminal equipment, the invention provides a mobile radio testing unit with which a mobile radio device contained in the freight can be detected if the freight is introduced into a closed explosion chamber in which real-time conditions are specified that coincide with ambient conditions of the freight on its intended transport path. "Mobile radio terminal equipment" is thereby understood to mean any electronic device or component that is able to implement at least the essential functions of a mobile radio device and that can, in particular, be logged into a mobile radio network so as to receive and/or send signals there. Mobile radio terminal equipment is, in particular, understood to be an electronic device or component that can be logged into a mobile radio network so as to receive signals and to serve as a receiver for the ignition command for an explosive charge and, perhaps, is able to transmit an ignition signal to an explosive charge. It can thereby be, for example, a GSM module without a display and/or keyboard.

The mobile radio testing unit is located in or on the simulation chamber and sends a test signal into the interior of the explosion chamber, wherein the test signal has a sufficient signal strength that it can be received by traditional mobile radio terminal equipment that is located in the freight to be investigated. The mobile radio signals (test signals) sent by the mobile radio testing unit into the explosion chamber thereby simulate mobile radio base stations. Appropriately, such mobile radio signals are simulated by mobile radio base stations and are sent at an intended target site of the freight or an intermediate target by a local mobile radio base station and can be received by traditional mobile radio terminal equipment.

The mobile radio signals sent by the mobile radio testing unit into the explosion chamber correspond, for the purpose, to those (downlink) mobile radio signals that, in particular, are emitted by public mobile radio networks on the intended transport path of the freight and, in particular, at the target site and/or at intermediate targets and that can be received by mobile radio terminal equipment. Ideally, all mobile radio networks that are available at the target site of the freight and, appropriately, also at all intermediate targets and that emit mobile radio signals there via mobile radio base stations are simulated in this way.

The mobile radio testing unit is preferably set up in such a way that it sends a test signal (mobile radio signal) into the explosion chamber, which causes mobile radio terminal equipment found in the interior of the explosion chamber to emit a signal that can be received by the mobile radio testing unit. Preferably, any mobile radio terminal equipment that is found in the interior of the explosion chamber is thereby induced to send a corresponding uplink signal that can be received by the mobile radio testing unit.

It is particularly expedient if the mobile radio testing unit is designed and set up in such a way that it sends an "update" signal into the explosion chamber, which induces mobile radio terminal equipment and, preferably, any mobile radio terminal device that is contained in the freight to carry out a so-called "location update." This "location update" makes it possible for the mobile radio terminal equipment to have access to a mobile radio network that is simulated by the mobile radio testing unit and that corresponds to a mobile radio network available at the target site or at an intermediate site of the freight. In order to make it possible for the mobile radio terminal equipment or any mobile radio terminal unit that is found in the interior of the explosion chamber to have access to the mobile radio network simulated by the mobile radio testing unit, the network components and/or settings of the mobile radio terminal equipment or unit are simulated for or to the mobile radio network simulated by the mobile radio testing unit. This makes it possible for any mobile radio terminal equipment found in the interior of the explosion chamber to be inevitably logged into the mobile radio network simulated by the mobile radio testing unit, to the extent that the mobile radio terminal equipment is able to do so. This ensures that any mobile radio terminal unit that is found in the interior of the explosion chamber and is simultaneously able to be logged into a mobile radio network that is available at the target site or at an intermediate site of the freight is also, in fact, logged into the mobile radio network simulated by the mobile radio testing unit and, in this way, can be recognized by the mobile radio testing unit.

With a "location update," carried out by the mobile radio terminal equipment, the user location specified to the mobile radio terminal equipment in a data storage unit or register (in GSM networks, for example, the "Home Location Register" (HLR) of the mobile radio terminal equipment), is changed in such a way that a feigned user location is set up. In WLAN-based networks, the feigning of a changed user location can also take place by sending a communication to the "HomeAgent" of the terminal device. The feigned user location is the intended target site of the freight and/or an intermediate site that is found on the intended transport route of the freight.

It is expedient if the mobile radio testing unit is set up in such a way that it detects a "location update" that is carried out or at least brought about by mobile radio terminal equipment found in the interior of the explosion chamber. If the mobile radio testing unit determines that at least one mobile radio terminal device found in the interior of the explosion chamber has carried out or at least brought about a "location update," this is expediently stored in a data bank or displayed on a screen. The mobile radio testing unit can also be preferably set up in such a way that it emits a warning signal if the carrying out of a "location update" was detected by a mobile radio terminal unit found in the freight. The display on a screen or the sending of a warning signal indicates that at least one mobile radio terminal unit that is found in the interior of the explosion chamber has logged into a mobile radio network simulated by the mobile radio testing unit. The mobile radio testing unit is then able and expediently set up to store the identification of such a mobile radio terminal device in a data bank or a testing protocol. In this way, it is possible to clearly identify any mobile radio terminal equipment that is found in the simulation chamber and that, at the same time, has logged into a mobile radio network simulated by the mobile radio testing unit. For this purpose, in particular, the "International Mobile Subscriber Identity" (IMSI) and/or the "International Mobile Station Equipment Identity" (IMEI) of the pertinent mobile radio terminal equipment are read by the mobile radio testing unit and expediently stored in the data bank or the testing protocol. Also, the identification data stored on the SIM card of the mobile radio terminal equipment can, for this purpose, be read and stored by the mobile radio testing unit.

If at least one mobile radio terminal unit found in the explosion chamber has been logged into at least one mobile radio network simulated by the mobile radio testing unit, the mobile radio testing unit can communicate with the pertinent mobile radio terminal equipment or unit, that is, exchange mobile radio signals. The mobile radio testing unit is preferably set up in such a way that, via this mode of communication, it can read the mobile radio number (call number) of any mobile radio terminal device that has a communication connection with the mobile radio testing unit. After reading the mobile radio numbers (call numbers), the mobile radio testing unit can call, using these mobile radio numbers, all mobile radio terminal devices that have been logged into a mobile radio network simulated by the mobile radio testing unit. If a pertinent mobile radio terminal device is designed as an igniter for a mobile radio-activated explosive charge, the explosive charge is brought to detonation with a call of the pertinent mobile radio terminal device by the mobile radio testing unit, and the freight package in which the explosive charge with the corresponding mobile radio terminal device, designed as the igniter, is destroyed.

It is particularly expedient if the mobile radio testing unit is set up in such a way that before a possible detonation of an explosive charge, it reads the identification data of the mobile radio terminal (in particular, the data stored on the SIM card) and stores them in a data bank or a testing protocol. Furthermore, the mobile radio testing unit is expediently set up in such a way that by means of a running time measurement, it can detect the position of every mobile radio terminal device in the interior of the explosion chamber that has been logged into at least one mobile radio network simulated by the mobile radio testing unit. In this way, it is possible (even after a detonation of an explosive charge has taken place in the simulation chamber) to identify a pertinent mobile radio terminal device that was designed as an igniter for the detonated explosive charge and, perhaps, to correlate it with a user and/or a freight package that was the component of the investigated freight.

BRIEF DESCRIPTION OF THE DRAWINGS

FIG. 1 schematically shows a simulation chamber in accordance with the disclosure.

DETAILED DESCRIPTION OF THE DISCLOSURE

These and other advantages of the invention can be deduced, in detail, from the embodiment example described below.

It is assumed that, to pursue terroristic goals, the blowing up of a large aircraft is intended, in that a freight package with an explosive charge is to be smuggled into the aircraft. Furthermore, it assumed that the explosive charge is to be ignited via a mobile radio terminal device, in particular, an original or also a modified GSM mobile part, in that the mobile radio terminal device is logged into a mobile radio network available there, at the target site or an intermediate site of the intended flight route, in order to obtain a signal for the ignition of the explosive charge from a local base station of this mobile radio network.

As an ignition signal, for example, one can remove an integrated "alarm function," a call signal ("call tone") from the beeper or from the earpiece, with the aid of soldered-on wires and adapt them to an electric detonator with a simple amplifier (transistor), using the battery of the mobile radio terminal device. Depending on the type of device, these signals are also available on the expansion connector of the mobile radio terminal device. With some mobile radio terminal devices, the lighting is also turned on with a call. Its operating voltage can likewise be utilized as an ignition signal via subsequently installed connecting wires. Such modifications of mobile radio terminal devices can be recognized on an X-ray only poorly or not at all, and for this reason a traditional X-ray examination could not detect mobile radio terminal device designed as an igniter for an explosive charge and contained in an air freight package.

The use of digital interfaces of a mobile radio terminal device (such as an infrared interface or a bus interface) for the ignition of an explosive charge is likewise conceivable, but requires a higher technical outlay, but is likewise covered by the detection technology in accordance with the invention. Basically, one can proceed from the fact that the triggering of the ignition mechanism by a mobile radio terminal device can take place only on the ground, or depending on the geographic circumstances, at flight altitudes up to ca. 4000 m.

The simplest and most promising use for the attacker then takes place in the following manner: A mobile radio terminal device is bought in the target country (for example, Israel); its PIN number and call number are known. The device is registered in the home network (for example, at the public mobile radio network "IL ORANGE"); it is set on a manual mobile network code=IL ORANGE; and then it is once again turned off. Thus, the Israeli mobile radio network operator is stored as the only enabled mobile radio network on the SIM card of mobile radio terminal equipment. The mobile radio terminal equipment is then brought in arbitrary ways, for example, to Germany and hidden, together with the explosive charge, which contains an explosive material and a priming charge, in an air freight package. Before closing the air freight package, the energy storage unit (battery) of the mobile radio device is charged (wherein with many traditional mobile radio terminal devices, standby times of more than two weeks are possible). The mobile radio terminal device is then turned on and the valid PIN number is entered. The freight package is then turned over to a freight forwarder and it goes through the usual stations and safety checks, until it is then underway in the aircraft to the target site if all checks have been successfully passed.

In the meantime, in Israel, a text message (SMS) is dispatched to the known call number of the pertinent mobile radio terminal device, or a call is made to a previously set up mail box.

When the aircraft has arrived at the vicinity of the target site and is approaching the landing strip, the pertinent mobile radio terminal device will receive the constantly emitted identification of the enabled mobile radio network "IL ORANGE" and will log in there immediately. After the log-in has taken place, it will take another 2 minutes until the mobile radio terminal device designed as the igniter for the explosive charge automatically receives a call from the local mobile radio network of the target site, so as to transmit the text message or the mailbox contents. This call then ignites the explosive charge while still in the air or on the ground. The mailbox could also transmit a code that contains the explosion command.

Other terroristic uses of a mobile radio terminal device are conceivable, but require additional devices, such as delay timers, so that the ignition does not take place at the wrong time or at the wrong site. The mobile radio device could also, for example, trigger an altitude igniter or an explosion could be caused at the point of departure.

What all terroristic uses described above have in common is that an operation-ready mobile radio terminal device is located in the freight or in a package of the aircraft. Due to the vast number of possible call numbers and unknown network selection mode, it is impossible to identify a mobile radio terminal device designed as an explosive charge igniter by means of a call or to bring about the explosion (in an explosion chamber), so as to prevent, in this way, the freight package with the explosive charge from being introduced into the aircraft. Furthermore, the mobile radio terminal device designed such that the explosive charge igniter must be turned on, so as to be able to ignite the explosive charge, since after an automatic turning on, the PIN number cannot be entered via the display if the mobile radio terminal device in the freight package is in the aircraft.

Therefore, one must assume that the mobile radio terminal device is active and has been logged into one of the locally available mobile radio networks via the automatic network selection mode or at least has heard the local cell broadcast messages and otherwise continues to be passive (manual network pre-selection, a network that is locally not available is selected).

A mobile radio terminal device designed as the explosive charge igniter can be detected only if it is possible to cause its transmitting part to emit one or more BURST signals. The locating of the device interfering radiation (emissions of the receiver) is not possible, since this is extremely low and is, above all, present only for a few milliseconds. Therefore, the invention proposes the simulation of mobile radio base stations (BST) with characteristics and identifications suitable for the intended flight route, so as to detect a mobile radio terminal device designed as an explosive charge igniter in a simulation chamber and to set off, in an explosion chamber, an explosive charge contained in the freight, so as to, in this way, prevent the explosive charge from being introduced into an aircraft.

FIG. 1 schematically shows a simulation chamber in accordance with the invention. It comprises an explosion chamber 1 with an explosion-proof housing 1*a*, into which is brought the freight 2 to be investigated.

The explosion chamber 1 can be closed for this purpose with a portal. Outside the explosion chamber, there is a control cabinet 3, which contains control electronics with a control program (control software) to control the simulation functions of the simulation chamber. There is a mobile radio testing unit 4 in the control cabinet 3. The mobile radio testing unit 4 is connected, via a high-frequency cable 5, to antennae 6, which are located within the explosion chamber 1. It is expedient to place an EMF filter, which filters out high-frequency interfering radiation from the environment, in the high-frequency connection between the mobile radio testing unit 4 and the antennae 6.

The mobile radio testing unit 4 has a transmission unit and a receiving unit, via which it can send or receive mobile radio signals. Via the antenna 6, a mobile radio test signal is sent into the interior of the explosion chamber 1 by the mobile radio testing unit 4. The mobile radio test signals sent out by the mobile radio testing unit thereby simulate mobile radio signals from mobile radio networks available from base stations. The assumption below is that the mobile radio test signals of the mobile radio testing unit simulate base stations of GSM mobile radio networks in this way. Furthermore, it is assumed that an air freight to be conveyed by an aircraft is investigated with the simulation chamber; for this purpose, it is introduced into the explosion chamber 1. The intended flight route of the air freight, in particular the flight destination and any intermediate sites (intermediate landing places), are thereby known and are deposited in a data bank in the control program of the simulation chamber.

In the control cabinet of the simulation electronics and in the explosion chamber, additional electronics and antennae have been installed. Suitable base stations (BTS) are simulated by means of this installation.

The names of the intermediate landing places and the flight target (3-letter code) are delivered to the mobile radio testing unit by an expansion of the simulation control program. From a data bank maintained by remote telephone maintenance, the mobile radio testing unit looks for the data for the network stimulation, such as the country code, the network number, the network operator, the "location area code," and so forth.

A network monitor receives the transmission signals ("cell broadcast messages") of the locally available base stations (that is, at the site of the simulation chamber), determines the allocation of the communication channels, and transmits the data obtained to the control program of the mobile radio testing unit. By this expansion, the mobile radio testing unit recognizes the channel allocation by local base stations and can deflect to unallocated channels.

After the start of the main simulation process (after closing the portals of the explosion chamber 1), the mobile radio testing unit first simulates all local mobile radio networks with changed site code with approximately 5-10 times the field strength (relative to the interior of the explosion chamber) and the request for the carrying out of a "location update," so as to then feign a site change in the mobile radio terminal devices 10 found in the freight to be investigated. The mobile radio terminal devices 10 react to this and carry out a "location update," that is, they produce a mobile radio connection with the mobile radio testing unit, in order to log in there. Each local network is simulated for ca. 3 minutes in this way. The receiving part of the mobile radio testing unit detects any "location update" attempts by mobile radio terminal devices 10 that are in the freight and automatically produces a signal or an alarm, which is displayed, for example, on a screen 12 on the control cabinet 3. Thus, all active and functional mobile radio terminal devices that are in the explosion chamber and are enabled for the local mobile radio networks and could act as mobile radio igniters for explosive charges are recognized.

If the flight route includes an intermediate landing, all local mobile radio networks available at the intermediate landing sites are subsequently simulated in a corresponding manner in the explosion chamber. The simulation takes place on a free broadcast channel frequency with the features made available from the database (country, network, LAC, network operator name, etc.).

After the expiration of the time stipulated for the flight route, all local mobile radio networks of the flight target site are correspondingly simulated. At least 5 minutes of simulation time are expediently provided per network. This takes into consideration that a mobile radio terminal device that has no longer found its home network for a longer period of time carries out the network search more slowly for power-saving reasons.

If the mobile radio testing unit has produced a mobile radio connection to a mobile radio terminal device found in the explosion chamber, the mobile radio terminal device can be located in the explosion chamber by means of a handheld detection finder antenna in a special operating mode, or can be called by the mobile radio testing unit. If the pertinent mobile radio terminal device is designed as an igniter for an explosive charge, an explosion is brought about in this way to ignite the explosive charge with a call.

For intelligence work, the IMSI and the IMEI of the detected mobile radio terminal devices are determined in any case and made available in a data bank 14 or a protocol. With the aid of the network operators (database), data such as device type and, above all, the name and address of the person who registered the device can be determined.

The simulation of mobile radio channels on the channels of the local mobile radio network operators can produce a collision with the mobile radio network operators, because the commercial mobile radio networks can be disturbed by the simulation or because an intervention is carried out into the mobile radio traffic of these networks. Since the detection method in accordance with the invention takes place only in the closed explosion chamber, one has to reckon, however, with a very limited extension of the interference because of the shielding effect of the explosion chamber. The interference can, however, still be detected in an extension of a maximum 50-150 m around the explosion chamber, which, in practical operation, with consideration of the preference of safety concerns with regard to the network operators, should be acceptable. The "mobile telephone protection area" can be minimized by additional shielding measures in the explosion chamber, wherein, however, the costs are increased.

The invention is not limited to the embodiment example described. Thus, not only mobile radio networks of the second generation (GSM networks), but also mobile function networks of higher generations (2.5G, 3G networks, etc.), such as according to the GPRS or the UMTS standard, can be simulated by the mobile radio testing device. Furthermore, the invention is not limited to its use for the safety testing of air freight. For example, freight or packages that are to be transported by other modes of transport, such as trains or trucks, can also be investigated. The simulation of mobile radio networks in accordance with the invention can also be used in a generic simulation chamber in combination with other simulation methods, for example, the simulation of reduced and/or excess pressure, the simulation of sound waves and/or electromagnetic waves, the emission of gases or radioactive radiation, or a location or position simulation via a GPS system, in which, with the aid of the intended transport route of the freight, possible locations that are feigned to a GPS receiver, perhaps contained in the freight, are simulated with a GPS sender. The location or position simulation via a GPS system can also be carried out without the mobile radio network simulation in accordance with the invention, and independent of the other simulation methods.

The invention claimed is:

1. Simulation chamber for activation of explosive charges contained in freight to be transported on an intended transport path, with mobile radio base stations of mobile radio networks sending downlink signals into areas of the transport path, the simulation chamber comprising:

a closed explosion chamber for receiving freight that may contain explosive charges activated by mobile radio terminal devices;

a mobile radio testing unit sending mobile radio signals into the explosion chamber, the mobile radio signals simulating the mobile radio base stations of mobile radio networks and causing a mobile radio terminal device contained in the freight to send back an uplink signal to the mobile radio testing unit and thereby activate the explosive charges activated by a mobile radio terminal device contained in the freight in a controlled manner within the closed explosion chamber.

2. Simulation chamber according to claim 1, wherein the intended transport path of the freight has a predetermined destination and/or predetermined intermediate targets and wherein the mobile radio signals sent by the mobile radio testing unit into the explosion chamber are simulating downlink mobile radio signals that are sent by local mobile base stations at the destination of the freight and/or at intermediate targets of the freight.

3. Simulation chamber according to claim 1, wherein the mobile radio testing unit further sends an update signal into the explosion chamber that causes a mobile radio terminal device contained in the freight to carry out a "location update".

4. Simulation chamber according to claim 3, wherein the "location update" carried out in the mobile radio terminal device enables the mobile radio terminal device to have access to a mobile radio network that is simulated by the mobile radio testing unit, for which purpose the network components and/or settings of the mobile radio terminal device are updated for the mobile radio network simulated by the mobile radio testing unit.

5. Simulation chamber according to claim 3, wherein the mobile radio testing unit detects the carrying out of a "location update" by a mobile radio terminal device in the freight and stores detection of a "location update" in a data bank and/or displays it on a screen and/or emits a warning signal if the carrying out of a "location update" was detected by a mobile radio terminal device located in the freight.

6. Method for activation of explosive charges contained in freight in a simulation chamber, in a controlled manner and under simulated conditions, wherein the freight is to be transported on an intended transport path and may contain explosive charges that can be activated by a mobile radio terminal device, the method comprising:

introducing the freight into a closed explosion chamber of the simulation chamber, transmitting mobile radio signals with a mobile radio testing unit into the explosion chamber, the mobile radio signals simulating mobile radio base stations of mobile radio networks and causing all mobile radio terminal devices contained in the freight to send back an uplink signal to the mobile radio testing unit and thereby activate the explosive charges contained in the freight in a controlled manner within the closed explosion chamber.

7. Method according to claim 6, wherein the intended transport path of the freight has a predetermined destination and/or predetermined intermediate targets and wherein the mobile radio testing unit sends at least one mobile radio signal into the explosion chamber that corresponds to a downlink signal of a local mobile radio network at the destination or an intermediate target of the freight.

8. Method according to claim 6, wherein upon detection of a mobile radio terminal device in the freight, the detected mobile radio terminal device is located and/or called by the mobile radio testing unit.

9. Method according to claim 6, wherein upon detection of a mobile radio terminal device in the freight by the mobile radio testing unit based on a running time measurement, the mobile radio testing unit carries out a determination of the position of the detected mobile radio terminal device.

10. Method according to claim 6, wherein upon detection of a mobile radio terminal device in the freight, identification data of the detected mobile radio terminal device including an "International Mobile Subscriber Identity" (IMSI) of the detected mobile radio terminal device and/or an "International Mobile Station Equipment Identity" (IMEI) of the detected mobile radio terminal device are read by the mobile radio testing unit and/or stored in a data bank or a testing protocol.

11. Method according to claim 6, wherein the signals sent by the mobile radio testing unit into the explosion chamber are shielded by the explosion chamber, and the signal strength outside the explosion chamber is below a maximum limiting value, which is selected in such a manner that it does not influence or interfere with the local mobile radio networks at the site of the simulation chamber.

12. Method according to claim 6, wherein the intended transport path of the freight has a predetermined destination and/or predetermined intermediate targets and wherein the mobile radio signals sent by the mobile radio testing unit into the explosion chamber simulate the mobile radio signals that are sent by local mobile base stations at the destination of the freight and/or at intermediate targets of the freight.

13. Method according to claim 6, wherein the intended transport path of the freight has a predetermined destination and/or predetermined intermediate targets and wherein the mobile radio testing unit sends at least one mobile radio signal into the explosion chamber that corresponds to a downlink signal of a local mobile radio network at the destination or an intermediate target of the freight.

14. Method according to claim 13, wherein the intended transport path of the freight has a predetermined destination and/or predetermined intermediate targets, each mobile radio terminal device contained in the freight is comprising a data storage unit in which an actual operator site is registered and wherein upon the execution of the "location update" in one of the mobile radio terminal devices, the registered actual operator site of said mobile radio terminal device is changed into a feigned operator site, the feigned operator site corresponding to an operator site of the mobile radio device at the destination of the freight and/or an intermediate site of the freight.

15. Method according to claim 6, wherein the mobile radio testing unit sends an update signal into the explosion chamber that causes at least one of the mobile radio terminal devices contained in the freight to execute a "location update".

16. Method according to claim 15, wherein the "location update" executed in the mobile radio terminal device enables the at least one of the mobile radio terminal devices to have access to a mobile radio network that is simulated by the mobile radio testing unit, for which purpose the network components and/or settings of the at least one of the mobile radio terminal devices are updated for the mobile radio network simulated by the mobile radio testing unit.

17. Method according to claim 15, wherein the mobile radio testing unit detects the execution of the "location update" and stores the execution in a data bank and/or displays the execution on a screen and/or emits a warning signal notifying that the execution of the "location update" was detected.

* * * * *